US007004507B2

(12) United States Patent
Shulman

(10) Patent No.: US 7,004,507 B2
(45) Date of Patent: Feb. 28, 2006

(54) COMBINED POSTER BOOK SYSTEM AND METHOD

(76) Inventor: Neil Barnett Shulman, 2272 Vistament Dr., Decatur, GA (US) 30033

( * ) Notice: Subject to any disclaimer, the term of this patent is extended or adjusted under 35 U.S.C. 154(b) by 223 days.

(21) Appl. No.: 10/162,130

(22) Filed: Jun. 4, 2002

(65) Prior Publication Data

US 2002/0175516 A1 Nov. 28, 2002

Related U.S. Application Data

(60) Provisional application No. 60/366,304, filed on Mar. 21, 2002.

(51) Int. Cl.
*B42D 15/00* (2006.01)

(52) U.S. Cl. ..... 283/106; 283/34; 283/62; 281/2; 281/15.1; 281/36; 281/37; 281/38; 40/124.09; 40/124.13; 40/610; 40/630; 493/356; 434/81; 434/137

(58) Field of Classification Search ..... 281/2, 281/15.1, 36–38; 283/34, 62; 40/124.09, 40/124.13, 610, 630; 493/356; 434/81, 434/136

See application file for complete search history.

(56) References Cited

U.S. PATENT DOCUMENTS 1,161,580 A * 11/1915 Allen ..... 40/530
2,333,569 A * 11/1943 Higgins ..... 281/5
4,010,299 A * 3/1977 Hershey et al. ..... 428/44
4,487,431 A * 12/1984 Kelly ..... 283/117
5,018,764 A * 5/1991 Beardell ..... 281/2
5,234,231 A * 8/1993 Hollander et al. ..... 281/2
5,655,866 A * 8/1997 Bellanca ..... 412/1
5,909,899 A * 6/1999 Vijuk et al. ..... 283/81
6,007,895 A * 12/1999 McDonald ..... 428/121

(Continued)

FOREIGN PATENT DOCUMENTS

FR 744196 * 4/1933

(Continued)

*Primary Examiner*—Boyer Ashley
*Assistant Examiner*—Mark Henderson

(57) ABSTRACT

A flat sheet of paper, or other thin flexible material, has information printed on one side in the form of a plurality of discrete panels or areas of text or images, while the entire other side is taken up by a large-scale, poster-like pattern. The panels or areas of text or images, are defined by crease lines created by folding the sheet of material. These creases are formed using a perpendicular fold method described in detail in this application. Each fold is perpendicular to the previous fold, creating a grid-like pattern, with each panel in the grid pattern containing a discrete quantity of text or images. When the invention is at its most folded state it has a relatively compact size. As the invention is unfolded, the panels of text or images are revealed in a specific sequence in order to tell a story or communicate some other type of sequentially ordered information. Once the entire sequence of information has been unfolded, the poster-like pattern on the back side of the sheet of material is unfolded and can be viewed and/or displayed.

1 Claim, 5 Drawing Sheets

U.S. PATENT DOCUMENTS 6,045,158 A * 4/2000 Bergstresser ..... 281/5
6,158,777 A * 12/2000 Twardosz ..... 283/62
6,189,933 B1 * 2/2001 Felderman ..... 283/34
6,354,985 B1 * 3/2002 Huber ..... 493/458
6,572,149 B1 * 6/2003 Long ..... 283/51
6,629,800 B1 * 10/2003 Brown ..... 402/58
6,644,694 B1 * 11/2003 Seawright ..... 283/34
6,669,235 B1 * 12/2003 Vijuk et al. ..... 283/67
6,837,290 B1 * 1/2005 Vijuk et al. ..... 156/356
6,964,413 B1 * 11/2005 Vijuk ..... 270/39.06
2002/0125712 A1 * 9/2002 Felderman ..... 283/34
2002/0175516 A1 * 11/2002 Shulman ..... 283/63.1

FOREIGN PATENT DOCUMENTS

GB 1379655 * 1/1975

* cited by examiner

COMBINED POSTER BOOK SYSTEM AND METHOD

PRIORITY CLAIM TO PROVISIONAL APPLICATION

The present application claims priority to provisional patent application entitled, "Posterbook," filed on Mar. 21, 2002 and assigned U.S. Application Ser. No. 60/366,304, the entire contents of which are incorporated by reference

FIELD OF THE INVENTION

The invention relates to dual-sided single sheet printed information, which is folded to a compact size.

BACKGROUND OF THE INVENTION

Patents have been granted to a variety of inventions for single sheet, dual sided printed matter, which is folded accordion style. These include U. S. Pat. No. 4,801,157 issued on Jan. 31, 1989 to Sink for a map folded in an accordion style. U.S. Pat. No. 5,234,231 was granted to Hollander et al. on Aug. 10, 1993 for a poster and catalog combination with accordion folds. And U.S. Pat. No. 4,538, 833 issued to Trikilis on Sep. 3, 1985 for a publication capable of being read in a manner similar to a magazine that is folded in an accordion style.

The accordion style folded sheet imposes serious limitations in the manner in which the printed matter presented can be read. Accordion style folds are usually created in parallel, meaning that the entire sheet must be completely unfolded to read the last panels in the sequence. This means that readers are either forced to hold a large and bulky sheet in their hands as they read, or the readers are required to refold the sheet as they read. Furthermore, in an accordion style fold, an indicator is not present to inform the reader of a starting place when unfolding the sheet to begin to read. The reader could start on any one of the pleats in the zigzag accordion fold. Because of the lack of organization and complexity of the accordion style fold, usually much space is needed to read the sheet when it is unfolded. This necessity for space makes the accordion style fold unsuitable for small quarters such as in the space of volume of a car, plane, etc. Another problem with the accordian style fold is it is difficult to gain access to particular sections that are at the bottom of a folded sheet. Often, the entire sheet must be open to gain access to sections at the bottom of the folded sheet.

Also, when the panels are intended to be a specifically sequenced series of panels of text and images, the accordion style fold is not the ideal form of presentation because of the problems mentioned above.

Unrelated to the problems associated with the accordion style folded sheets are problems associated with book publishing. Currently, book publishing expenses frequently deter potential authors from communicating their written word to audiences. Book publishing can be expensive because of the complex procedures and requisite materials needed to make a book. For example, book manufacturing often involves complex paper cutting procedures and binding methods. In addition to the costs associated with book publishing are expenses associated with shipping published books. Books are often large and bulky and not amenable for compact storage.

Accordingly, there is a need in the art for presenting printed matter on a medium in an organized fashion where the medium is not bulky and does not require significant expense to manufacture. Another need exists in the art for presenting printed matter on a medium that can be folded and unfolded without confusing the reader.

SUMMARY OF INVENTION

This invention can comprise a series of perpendicular folds in order to solve the problems of the conventional accordion-fold design. The perpendicular-fold method of the present invention can provide an improved way for a story to be told through a single sheet folded booklet design. This invention can be designed for printed matter which tells a story, but the design can be applicable to any printed matter that requires a specific sequence of discrete portions of information, such as pages in a book.

The present invention can provide an appropriate and simple way to read a story or other sequence of information as told by a series of panels printed on the same side of a sheet of paper and folded into a booklet, forming a combined poster book. When the reader first receives a booklet, which is produced using the perpendicular fold method, the booklet can be in its most compact state. The reader can then unfold the booklet, revealing new panels in a specific sequence. The way in which a reader can unfold and read this invention is quite unique.

With each subsequent unfolding, the booklet grows in size in the readers hand, yet never becomes so large as to be unmanageable. Furthermore, the reader usually does not need to make any extra refoldings or turnings of the booklet: each subsequent unfolding immediately presents the set of panels that the reader can read next in the sequence.

This invention offers readers an advantageous way to read a story or other printed material. Unfolding the book and poster combination of the present invention can be fun and interesting, particularly for children. Once the reader has finished reading the booklet, the booklet can be fully unfolded to reveal a full-size poster comprising printed matter suitable for display. According to one exemplary aspect, the full-size poster comprises information that can be related to the story on the opposing side. For example, the poster can relate to a theme of the story.

DETAILED DESCRIPTION OF THE DISCLOSURE

Figure 1:
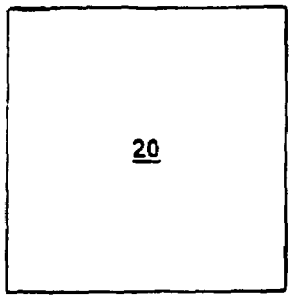
FIG. 1 illustrates a sheet of thin, flexible material in an uncreased state that is suitable for folds according to one exemplary embodiment of the present invention.

Referring now to FIG. 1, this figure illustrates a sheet 20 of thin flexible material which is in an uncreased state. FIG. 2 to FIG. 10 illustrate one exemplary fold process of taking an uncreased sheet 20 of thin flexible material and folding it using a perpendicular fold method to render an embodiment of the present invention. The flexible material of the present invention can comprise paper, and specifically, plasticised paper. However, other flexible materials are not beyond the scope of the present invention. Other flexible materials can include, but are not limited to fabric or cloth materials, plastic, metal, cardboard, and combinations thereof that can be folded and unfolded in accordance with the present invention. For a non-limiting example, the flexible material could comprise mylar or other foil-like materials that can support printed matter.

Figure 2:
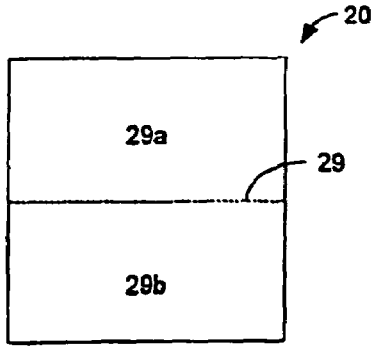
FIGS. 2–10 illustrate one exemplary set of steps in the perpendicular fold method according to one exemplary embodiment of the present invention.

In FIG. 2, a transverse or latitudinal first crease 29 can be made in the sheet 20 of material, dividing it in half and into upper and lower sections 29*a* and 29*b*. Each crease discussed herein has less fold-resistance than uncreased material but each crease also has enough strength to be folded and unfolded numerous times with minimal or reduced tearing. It is desirable that the material of the sheet 20 does not tear but it is recognized that with age of any sheet of folded material at some point failure or tearing can occur.

Figure 3:
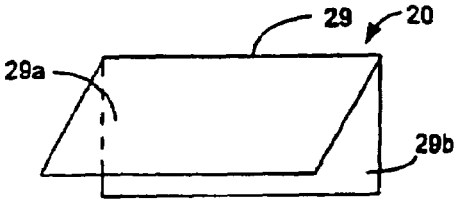

FIG. 3 illustrates the sheet 20 of material being folded about the first crease 29. Once the fold is complete, the upper half section 29*a* of the first side surface is in an inwardly facing direct contacting relationship with the lower half section 29*b* of the first side surface. Specifically, the lower half section 29*b* is moved in an upward manner and closed along the first crease 29 towards the upper half section 29*a* such that the upper half section 29*a* remains stationary during this fold subprocess.

Figure 4:
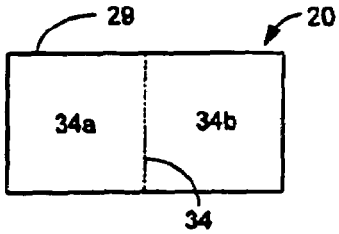
Figure 5:
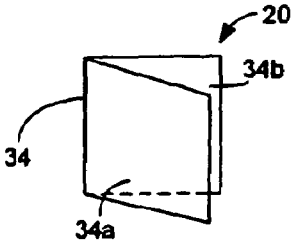

FIG. 4 illustrates the sheet 20 after the first fold along first crease 29 (shown in FIG. 5). As seen FIG. 4, the original sheet 20 of material has been folded once such that it is two sheets thick. The top edge of FIG. 4 is the crease 29 from FIGS. 2 and 3. A second crease 34 is then made in sheet 20 dividing it in half and into first and second side sections 34*a* and 34*b*. The second crease 34 is a longitudinal crease that is oriented at ninety degrees relative to the first transverse or latitudinal crease 29.

Figure 6:
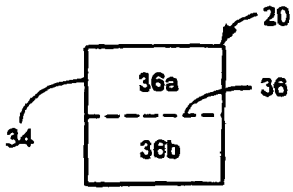

FIG. 5 illustrates the sheet 20 of material being folded about the second crease 34 where the first side section 34*a* is moved or closed along the second crease 34 towards the second side section 34*b*, the second side section 34*b* remaining stationary during this fold subprocess. Once the fold is complete, the first side section 34*a* is in an inwardly facing direct contacting relationship with the second side section 34*b*. FIG. 6 illustrates the sheet 20 after the second fold along second crease 34 (shown in FIG. 5). As seen in FIG. 6, the original sheet 20 of material has been folded twice such that it is four sheets thick. The side edge of FIG. 6 is the second crease 34 from FIGS. 4 and 5.

A third crease 36 is then made in sheet 20 dividing it in half and into first and second half sections 36*a* and 36*b*. The third crease 36 is a transverse or latitudinal crease that is oriented at ninety degrees relative to the second longitudinal crease 34.

Figure 7:
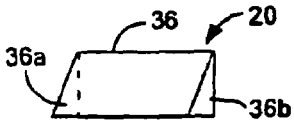
Figure 8:
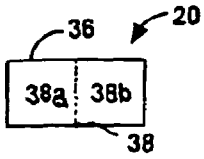

FIG. 7 illustrates the sheet 20 of material being folded about the third crease 36 where the upper section 36*a* is moved or closed along third crease 36 towards the lower section 36*b*, the lower section 36*b* remaining stationary during this folding subprocess. Once the fold is complete, the first upper section 36*a* is in an inwardly facing direct contacting relationship with the second lower section 36*b*. FIG. 8 illustrates the sheet 20 after the third fold along third crease 36 (shown in FIG. 7). As seen FIG. 8, the original sheet 20 of material has been folded three times such that it is eight sheets thick. The top edge in FIG. 8 is the crease 36 from FIGS. 6 and 7.

A fourth crease 38 is then made in sheet 20 dividing it in half and into first and second half side sections 38*a* and 38*b*. The fourth crease 38 is a longitudinal crease that is oriented at ninety degrees relative to the third latitudinal or transverse crease 36.

Figure 9:
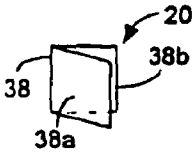
Figure 10:
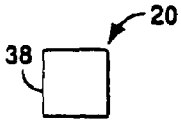

FIG. 9 illustrates the sheet 20 of material being folded about the fourth crease 38 where the first side section 38*a* is moved or closed along the fourth crease 38 towards the second side section 38*b*, the second side 38*b* section remaining stationary during this fold subprocess. Once the fold is complete, the first side section 38*a* is in an inwardly facing direct contacting relationship with the second side section 38*b*. FIG. 10 illustrates the sheet 20 after the fourth fold along fourth crease 34 (shown in FIG. 8). As seen in FIG. 10, the original sheet 20 of material has been folded four times such that it is sixteen sheets thick. The side edge in FIG. 10 is the crease 38 from FIGS. 8 and 9.

Figure 11:
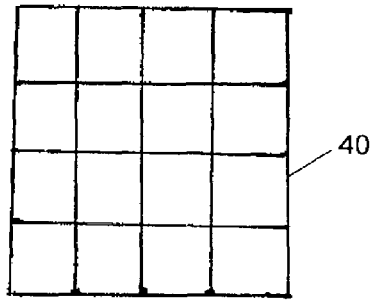
FIG. 11 illustrates an exemplary resulting grid pattern of panels after a series of four perpendicular folds according to one exemplary embodiment of the present invention.

FIG. 11 illustrates an exemplary grid pattern 40 resulting from four perpendicular creases made in accordance with an exemplary embodiment of the present invention. It is noted that the invention is not limited to four perpendicular folds. The number of folds chosen is simply based on the number of panels desired in the finished product. Four folds were chosen as an example since it is a simple example to illustrate. In summary, FIGS. 1–9 illustrate an exemplary folding process where each fold made is perpendicular to a previous fold and where each fold reduces the surface area of the booklet by fifty-percent.

Figure 12:
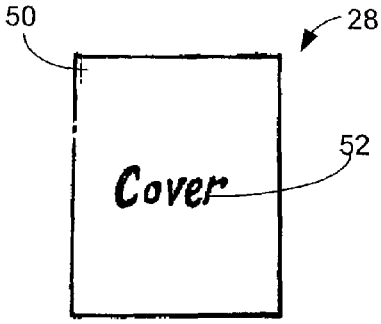
FIG. 12 illustrates an exemplary front plan of the cover sheet of a sheet folded according to one exemplary embodiment of the present invention that also comprises printed matter arranged in a predetermined sequence.

Referring now to FIGS. 12–21, these figures illustrate the process of unfolding a combined poster book 28 according to one exemplary embodiment of the present invention. In FIG. 12, a cover 50 of the combined poster book 28 is illustrated. The cover 50 has printed matter 52 that is oriented such that it can be read. In the folded state illustrated in FIG. 12, the combined poster book 28 of the exemplary embodiment illustrated is sixteen pages in thickness. However, those skilled in the art will appreciate that the present invention can have any number of folds and therefore, the thickness could be increased or decreased when the combined poster book 28 is in its most compact state as illustrated in FIG. 12.

Figure 13:
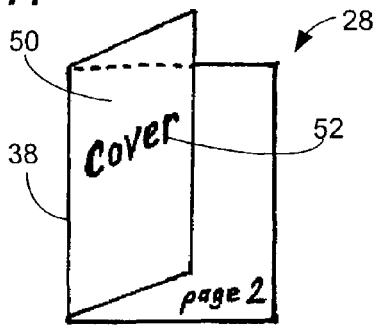
FIGS. 13–20 illustrate the sequence for unfolding a completed embodiment of the invention.
Figure 14:
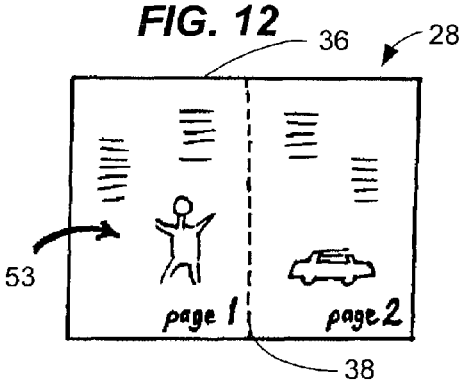

Referring now to FIG. 13, this figure illustrates the opening of the combined poster book 28 along a fourth crease 38 that comprises a fold in the combined poster book 28. The cover 50 can be opened similar to a book. That is, the cover 50 can be turned so that an opposite side 53 comprising page 1 of some printed matter can be read as illustrated in FIG. 14. FIG. 14 further illustrates a page 2 of printed matter that is on an opposite side of the fourth crease 38. Perpendicular to the fourth crease 38 and located on a top portion of pages 1 and 2 is a third crease 36.

Figure 15:
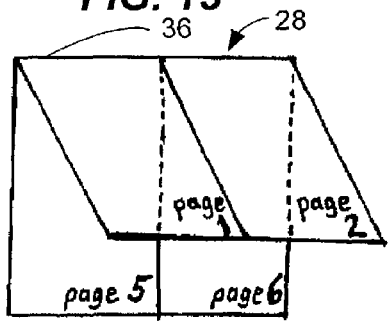
Figure 16:
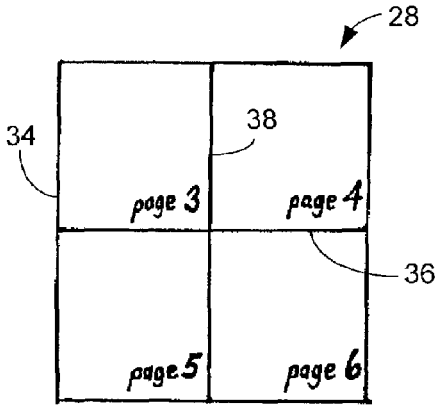

FIG. 15 illustrates the opening of the combined poster book 28 along the third crease 36 that comprises a fold in the combined poster book 28. Pages 1 and 2 can be turned so that an opposite side of pages 1 and 2 comprising pages 3 and 4 of some printed matter can be read as illustrated in FIG. 16. FIG. 16 further illustrates pages 5 and 6 of printed matter that is on an opposite side of the third crease 36. While pages 3, 4, 5, and 6 are oriented such that they can be read from left to right, and then row by row, it is not beyond the scope of the present invention to sequence the printed matter such that the reading order would be page 3, 5, 4, and 6 or top-down, column by column. Any number of orientations of the printed matter can be used without departing from the scope and spirit of the present invention. Perpendicular to the third crease 36 and parallel to the fourth crease 38 and located on a side portion of pages 3 and 5 is a second crease 34.

Figure 17:
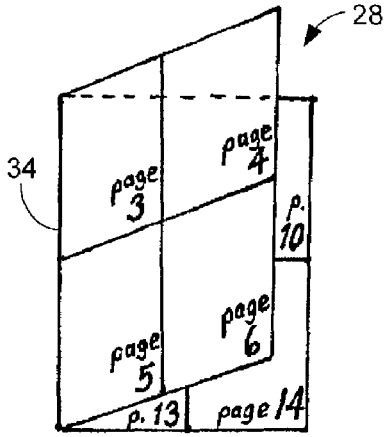
Figure 18:
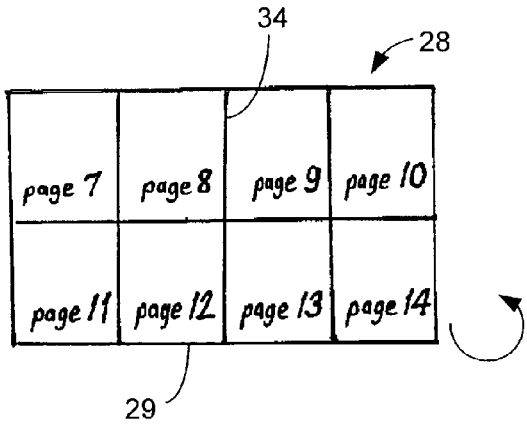

FIG. 17 illustrates the opening of the combined poster book 28 along the second crease 34 that comprises a fold in the combined poster book 28. Pages 3, 5, 4, and 6 can be turned as a unit or whole page so that an opposite side of this grouped set of pages comprising pages 7, 8, 11, and 12 of some printed matter can be read as illustrated in FIG. 18. FIG. 18 further illustrates pages 9, 10, 13, and 14 of printed matter that is on an opposite side of the second crease 34. While pages 7, 8, 9, 10, 11, 12, 13, and 14 are oriented such that they can be read from left to right, and then row by row, it is not beyond the scope of the present invention to sequence the printed matter such that the reading order could comprise page 7, 11, 8, 12, 9, 13, 10 and 14 or top-down, column by column. Any number of orientations of the printed matter can be used without departing from the scope and spirit of the present invention. Perpendicular to the second crease 34 and located on a bottom portion of pages 11, 12, 13, and 14 is a first crease 29.

Figure 19:
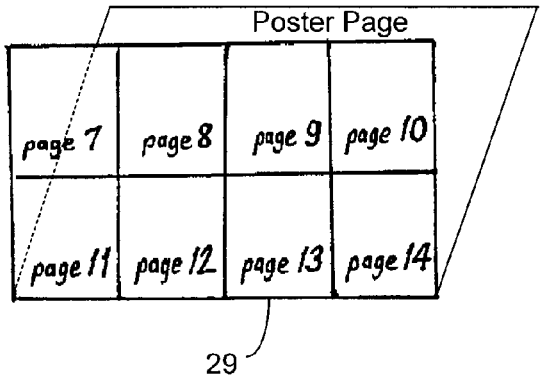
Figure 20:
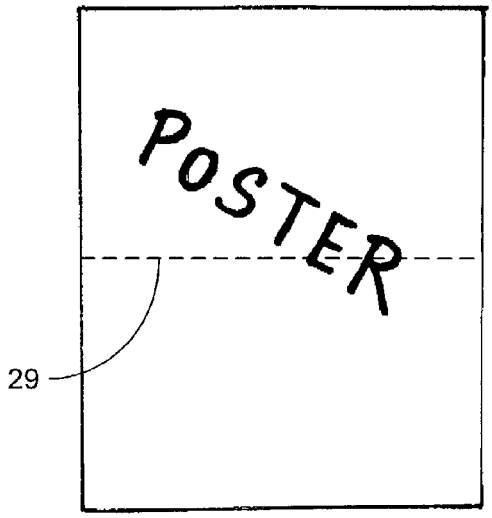

FIG. 19 illustrates the opening of the combined poster book 28 along the first crease 29 that comprises a fold in the combined poster book 28. Pages 7, 8, 9, 10, 11, 12, 13, and 14 can be turned as a unit or whole page so that an opposite side of this grouped set of pages comprising a poster 27 of some printed matter can be read as illustrated in FIG. 20.

Figure 21:
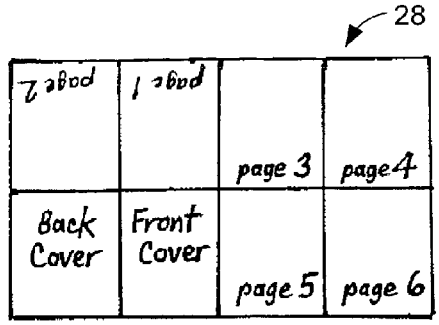
FIG. 21 illustrates a side of a combined poster book that is opposite to the side of the combined poster book illustrated in FIG. 18.

Referring to FIG. 21, this figure illustrates the opposite side of pages 7, 8, 9, 10, 11, 12, 13, and 14 when the combined poster book 28 is in folded state where the only remaining fold is along the first crease 29. This opposing side can be viewed if the side comprising pages 7, 8, 9, 10, 11, 12, 13, and 14 is rotated by 180 degrees.

Figure 22:
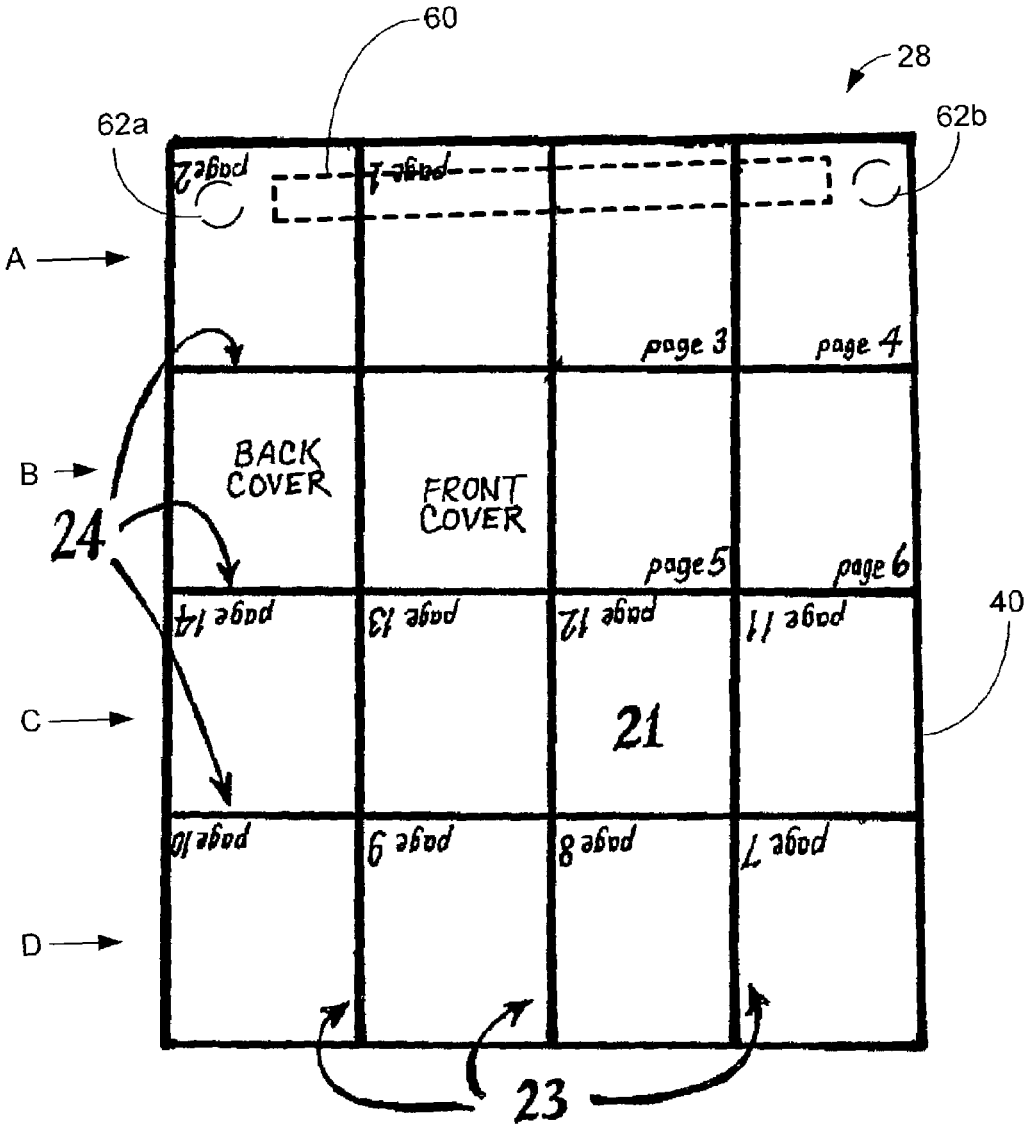
FIG. 22 illustrates an exemplary front plan view of a completely unfolded sheet, showing the side on which the discrete panels containing text and/or images are defined by fold lines according to one exemplary 16 panel embodiment of the present invention.

Referring now to FIG. 22, this figure illustrates a first side of an exemplary combined poster book 28 according to one exemplary embodiment of the present invention wherein the combined poster book 28 is in an unfolded state. The combined poster book 28 comprises a sheet of thin flexible material with a plurality of both longitudinal and latitudinal creases 23 and 24. FIG. 22 illustrates the orientation of the printed matter relative to each other as the poster book would be made prior to folding. The printed matter can comprise text, images, or a combination thereof. The printed matter can be arranged according to the page numbers discussed below so that information can be presented to a reader and logical and comprehensible manner similar to that of a book.

The order or sequence of the printed matter in combination with the perpendicular folding comprises one inventive aspect of the present invention where the printed matter on the panels is arranged such that when the poster book 20 is unfolded, the panels are in a prearranged or predetermined order as illustrated in FIG. 22.

Specifically, pages 1, 2, 3 and 4 are located in a first row A comprising cells of a grid pattern 40 where page 2 is positioned in the first column in a first cell; page 1 is positioned in the second column in a second cell; page 3 is positioned in the third column in a third cell; and page 4 is positioned in the fourth column in a fourth cell. Pages 1 and 2 are positioned such that their printed matter is oriented upside down or 180 degrees relative to pages 3 and 4 that are oriented in right-side up or correct readable orientation.

The back cover and front cover and pages 3 and 4 are located in a second row B of cells in the grid pattern 40 where the cover is positioned in the first column in the first cell; the back cover is positioned in the second column in the second cell; page 5 is positioned in the third column in the third cell; and page 6 is positioned in the fourth column in the fourth cell. For this second row B, the back cover and front cover as well as pages 3 and 4 are oriented in a right-side up or correct readable orientation relative to other printed matter on the same surface.

Pages 11, 12, 13 and 14 are located in a third row C of cells in the grid pattern 40 where page 14 is positioned in the first column in the first cell; page 13 is positioned in the second column in the second cell; page 12 is positioned in the third column in the third cell; and page 11 is positioned in the fourth column in the fourth cell. All pages in third row C are positioned such that their printed matter is oriented upside down or 180 degrees relative to other printed matter on the same surface.

Pages 7, 8, 9 and 10 are located in a fourth row D of cells in the grid pattern 40 where page 10 is positioned in the first column in the first cell; page 9 is positioned in the second column in the second cell; page 8 is positioned in the third column in the third cell; and page 7 is positioned in the fourth column in the fourth cell. Like the third row C, all pages in fourth row D are positioned such that their printed matter is oriented upside down relative to other printed matter on the same surface.

As noted above, the number and sizes of the cells are not limited to those illustrated in the figures. More or fewer cells as well as smaller or larger cells are not beyond the scope of the present invention.

Also illustrated in FIG. 22 are various optional mechanical structures that can be used to fasten the poster book 28 to a surface once it is unfolded so that the poster 27 illustrated on the opposite side can be displayed. One optional mechanical structure comprises a transparent strip or region of an adhesive 60 that can be applied to the poster book during manufacture. The adhesive can have a strength such that it can support the weight of the poster book 28 on a flat surface. However, the strength of the adhesive should not be strong enough as to prevent folding and unfolding of the poster book 28 prior to hanging the unfolded poster 27.

Another optional mechanical structure comprises apertures 62*a* and 62*b*. The apertures can be dimensioned so as to receive mechanical fasteners such as screws, nails, tacks, etc. The orientation, number, and size of the apertures 62*a* and 62*b* as well as the adhesive 60 are not limited to those shown in FIG. 22. Other orientations, numbers, and sizes of the apertures 62*a* and 62*b* as well as the adhesive 60 are not beyond the scope of the present invention.

Figure 23:
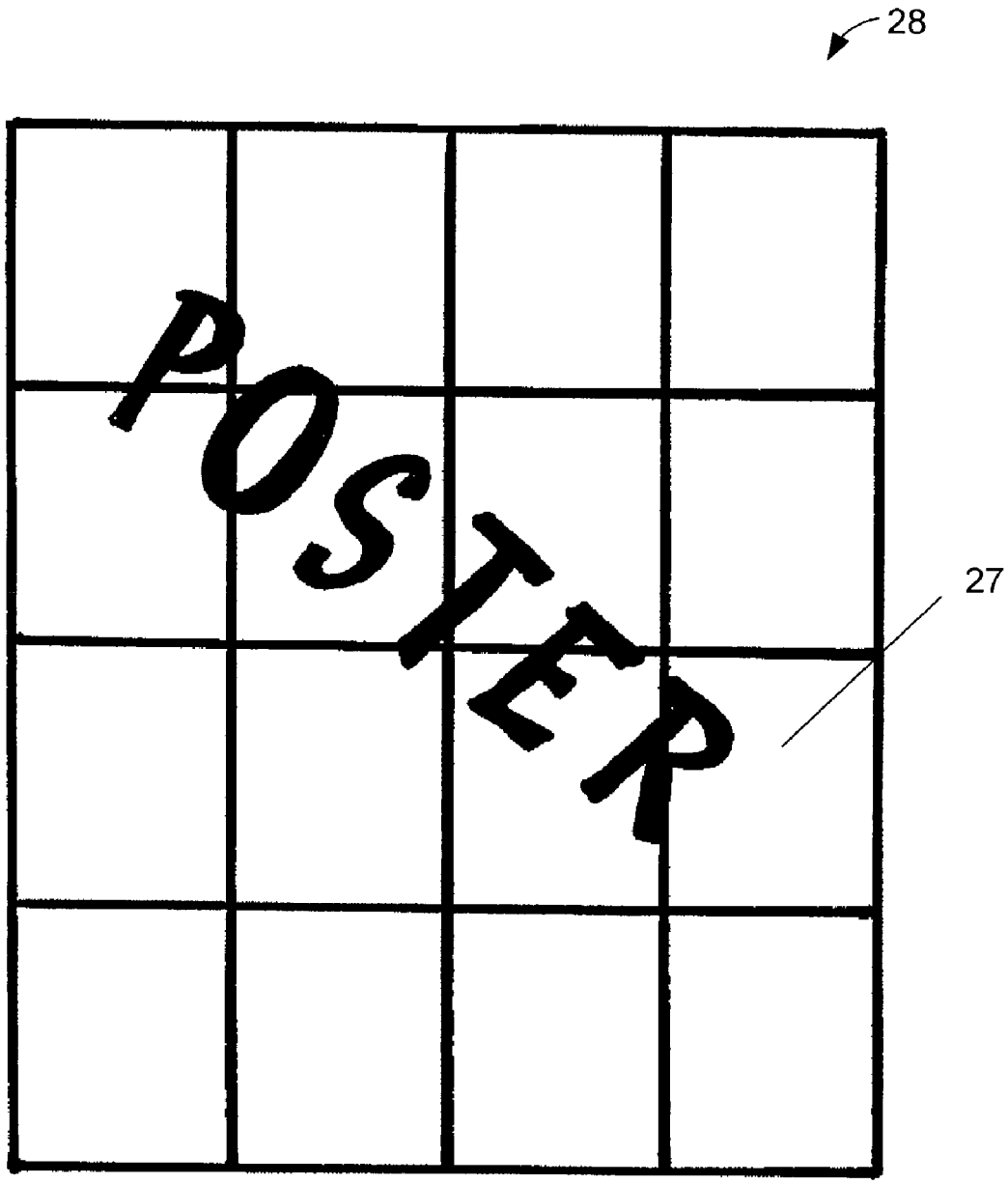
FIG. 23 illustrates a rear plan view of the unfolded sheet showing an exemplary poster according to one exemplary embodiment of the present invention.

Referring now to FIG. 23, this figure illustrates a second side of the exemplary combined poster book 28 illustrated in FIG. 22 wherein the combined poster book 28 is in an unfolded state. This figure illustrates an optional orientation of the poster 27 comprising printed matter that is displayed on the entire second side. Other orientations of the poster 27 comprising the printed matter can be made without departing from the scope and spirit of the present invention. If the poster 27 was rotated 180 degrees about longitudinal axis X—X, then the side of combined poster book 28 illustrated in FIG. 22 would be visible. As mentioned above, the relative orientation of the printed matter as well as the number of folds and the size of the unfolded, combined poster book 28 can be adjusted or changed without departing from the scope and spirit of the present invention.

Exemplary applications for the combined poster book 28 include children's stories, instructional manuals, greeting cards, promotional materials, sales materials and conference announcements. For children's books, children can enjoy the unique physical way in which the story unravels as well as the layout of images and text inherent to the combined poster book design. Children can also enjoy being able to put a poster up on their wall after finishing a poster book story.

For commercial marketing pamphlets, the combined poster book 28 can also be extremely useful as a pamphlet for a variety of companies from grocery stores to outdoor retailers. For example, suppose that a grocery store wants to explain and describe the different classifications of traditional, free range and organic chicken. A poster book 28 could be designed to explain these differences by way of a story with text and illustrations. The poster side of the poster book 28 could then have a large format illustration of the different categories of chicken which could be posted in the supermarket.

Another exemplary application for the hotel book could include using it as a training manual. For example, employees of a hotel who handle food must go through lengthy training programs to learn about proper methods of cleanliness. A poster book 28 could be a valuable learning tool for these types of classes. The methods of cleanliness could be explained in the unraveling of the poster book 28 and an illustrated list of rules could be printed on the poster and hung up for a highly visible reminder.

While preferred embodiments of the invention have been shown and described in detail, other modifications will be readily apparent to those having ordinary skill in this art. Accordingly, this disclosure should be regarded as exemplary rather than limiting, and the scope of the invention should be considered to be defined solely by the following claims.

What is claimed is:

1. A combined poster book, wherein a folded sheet of material has 4 creases which form a grid containing a total of 8 bilateral cells, said grid configured into 2 rows which each contain 4 of said 8 bilateral cells, with printed matter on an entire first surface of said folded sheet of material and printed matter on an entire second surface of said folded sheet of material, wherein said printed matter on said first surface of said folded sheet of material is arranged such that each of said 8 bilateral cells is occupied by a single self-contained page of sequenced information, and said printed matter on said second surface of said folded sheet of material occupies said entire second surface; and on said first surface of said sheet of material, an upper row of said 2 rows of 4 cells comprising said printed matter of a first 4 pages of a sequence of information, so that a page 2, a page 1, a page 3, and a page 4 of said printed matter are positioned consecutively from left to right and said printed matter of said pages 2 and 1 are oriented at 180 degrees relative to said printed matter of said pages 3 and 4, said printed matter of said pages 3 and 4 being oriented in an upright position, and a lower row of said 2 rows of 4 cells, comprising said printed matter of a remaining 4 pages of said sequence of information, so that a back cover, a front cover, a page 5, and a page 6 of said sequence of information is positioned consecutively from left to right, said printed matter of said back cover, front cover, page 5, and page 6 being oriented in said upright position of said pages 3 and 4; wherein said combined poster book has been achieved by folding said sheet of material into a most compact state by use of multiple perpendicular folds, such that, upon opening said combined poster book from said most compact state, each said single page of sequenced information is revealed in a logical order without any additional refolding or turning of said combined poster book, and wherein a first unfolding of said folded sheet of material is akin to a traditional opening of a book from right to left and reveals 2 of said 8 bilateral cells, with said first and second page of sequenced information occupying said 2 bilateral cells revealed with said first unfolding; and a second unfolding of said folded sheet of material opens said folded sheet of material from bottom to top with a motion which is at a perpendicular angle to said first unfolding, and reveals said third, fourth, fifth, and sixth said page of sequenced information positioned in 4 of said 8 bilateral cells, with said third and fourth pages of sequenced information positioned in a top 2 of said 4 bilateral cells, and said fifth and sixth pages of sequenced information positioned in a bottom 2 of said 4 bilateral cells revealed; and a third and final unfolding of said folded sheet of material opens said folded sheet of material from right to left with a motion which is at a perpendicular angle to said second unfolding, and reveals said entire second surface of printed matter.

* * * * *